US010890876B2

(12) United States Patent
Fukuma

(10) Patent No.: US 10,890,876 B2
(45) Date of Patent: Jan. 12, 2021

(54) IMAGE FORMING APPARATUS, TONER CONTAINER

(71) Applicant: KYOCERA Document Solutions Inc., Osaka (JP)

(72) Inventor: Nobuhiro Fukuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/298,143

(22) Filed: Mar. 11, 2019

(65) Prior Publication Data

US 2019/0286048 A1 Sep. 19, 2019

(30) Foreign Application Priority Data

Mar. 13, 2018 (JP) ..... 2018-045259

(51) Int. Cl.
*G03G 15/04* (2006.01)
*G03G 21/16* (2006.01)
*G03G 15/08* (2006.01)

(52) U.S. Cl.
CPC ..... *G03G 21/1647* (2013.01); *G03G 15/0875* (2013.01); *G03G 21/1619* (2013.01); *G03G 21/1676* (2013.01)

(58) Field of Classification Search
CPC ..... G03G 21/1676; G03G 21/1647; G03G 15/0865; G03G 21/1821; G03G 2221/1684
USPC ..... 399/119
See application file for complete search history.

(56) References Cited

U.S. PATENT DOCUMENTS 5,609,101 A * 3/1997 Oyama ..... B41F 31/02 101/116
2003/0049036 A1* 3/2003 Ueno ..... G03G 21/185 399/25
2009/0262029 A1* 10/2009 Chiang ..... H01Q 1/2266 343/702
2012/0027422 A1 2/2012 Itabashi
2014/0037331 A1 2/2014 Itabashi
2016/0103416 A1* 4/2016 Eto ..... G03G 21/1676 399/119

FOREIGN PATENT DOCUMENTS

JP 201232694 A 2/2012

* cited by examiner

*Primary Examiner* — Walter L Lindsay, Jr.
*Assistant Examiner* — Frederick Wenderoth
(74) *Attorney, Agent, or Firm* — Alleman Hall Creasman & Tuttle LLP

(57) ABSTRACT

An image forming apparatus according to the present disclosure includes an apparatus body, a toner container, a container supporting portion, and an exterior member. The toner container is configured to be attached at an attachment position that is specified inside the apparatus body. The container supporting portion is configured to support the toner container such that the toner container is movable between the attachment position and a pull-out position that is separated from the attachment position by a specific distance toward a specific first surface of the apparatus body. The exterior member is provided on the toner container, and constitutes an exterior of the first surface when the toner container is in an attached state, where the toner container is held at the attachment position by the container supporting portion.

12 Claims, 16 Drawing Sheets

IMAGE FORMING APPARATUS, TONER CONTAINER

INCORPORATION BY REFERENCE

This application is based upon and claims the benefit of priority from the corresponding Japanese Patent Application No. 2018-045259 filed on Mar. 13, 2018, the entire contents of which are incorporated herein by reference.

BACKGROUND

The present disclosure relates to an image forming apparatus comprising a removably attached toner container that includes a storage portion for storing toner.

There is known a conventional image forming apparatus configured to form an image on a sheet using a developer that includes toner. This type of image forming apparatus is provided with a toner container for replenishing toner to a developing device that is provided inside the apparatus. The toner container is removably attached in an apparatus body of the image forming apparatus. When the toner stored inside the toner container is depleted and the toner container becomes empty, the toner container is removed from the image forming apparatus, and it is replaced with a new toner container stored with unused toner.

When replacing the toner container, a cover that covers an opening on a top surface or side surface of the apparatus body is opened, and the toner container attached to the inside of the apparatus body is removed from the opening, or the toner container is attached to the inside of the apparatus body from the opening.

SUMMARY

An image forming apparatus according to an aspect of the present disclosure includes an apparatus body, a toner container, a container supporting portion, and an exterior member. The toner container is configured to be attached at an attachment position that is specified inside the apparatus body. The container supporting portion is configured to support the toner container such that the toner container is movable between the attachment position and a pull-out position that is separated from the attachment position by a specific distance toward a specific first surface of the apparatus body. The exterior member is provided on the toner container, and constitutes an exterior of the first surface when the toner container is in an attached state, where the toner container is held at the attachment position by the container supporting portion.

A toner container according to another aspect of the present disclosure is configured to be movable between an attachment position that is specified inside an image forming apparatus, and a pull-out position that is separated from the attachment position by a specific distance toward a specific first surface of an apparatus body. The toner container includes an exterior member that constitutes an exterior of the first surface when the toner container is disposed at the attachment position This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure. It is further noted that for convenience of explanation, a vertical direction in an installation state (shown in FIG. 1) where the image forming apparatus 10 is installed in a usable manner is defined as an up-down direction D1. In addition, a front-rear direction D2 and a left-right direction D3 are defined on a basis that the image forming apparatus 10 is in the installation state.

The image forming apparatus 10 according to the embodiment of the present disclosure includes at least a print function. The image forming apparatus 10 is, for example, a tandem-type color printer.

Figure 1:
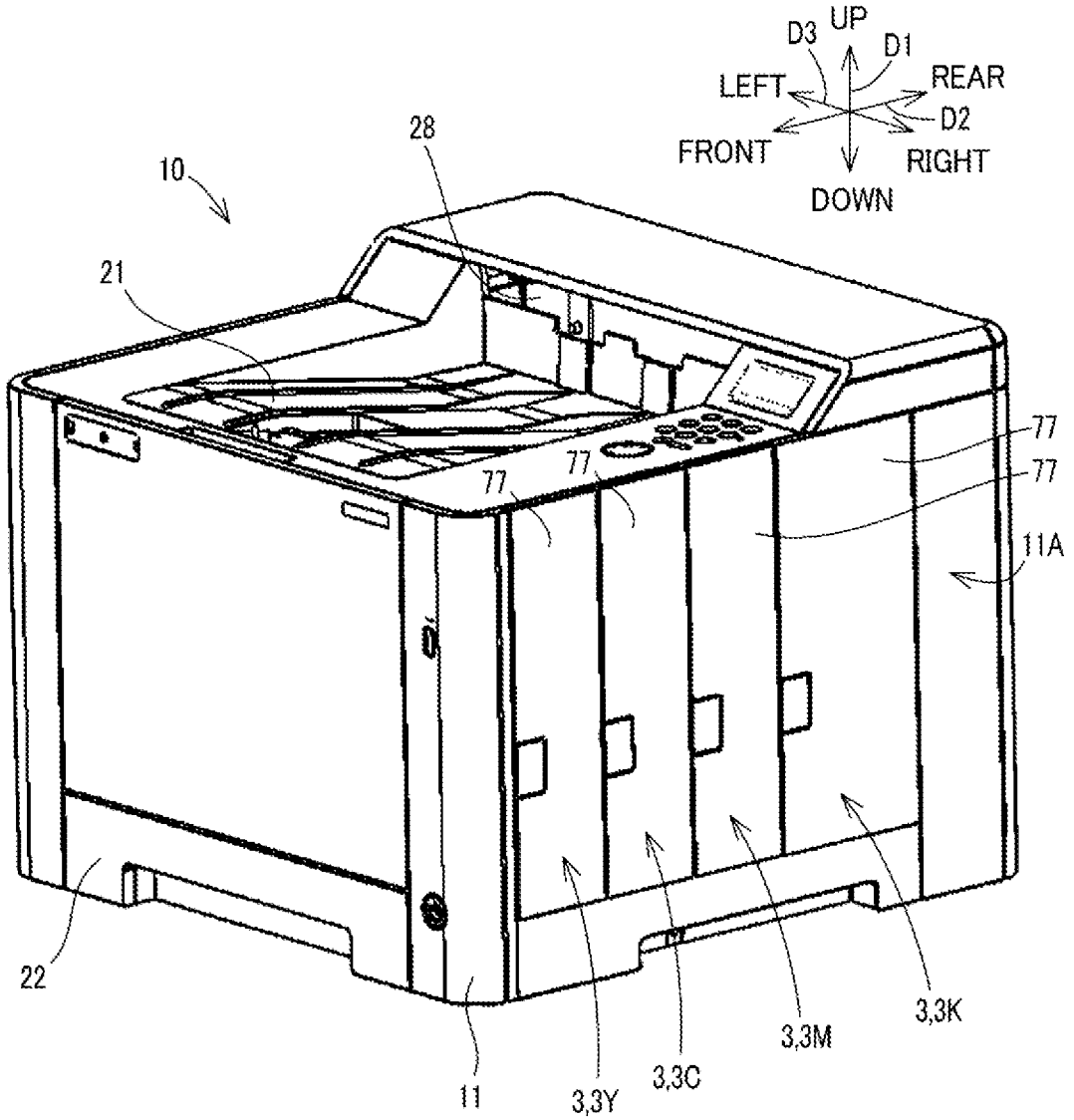
FIG. 1 is a perspective diagram showing a configuration of an image forming apparatus according to an embodiment of the present disclosure.
Figure 2:
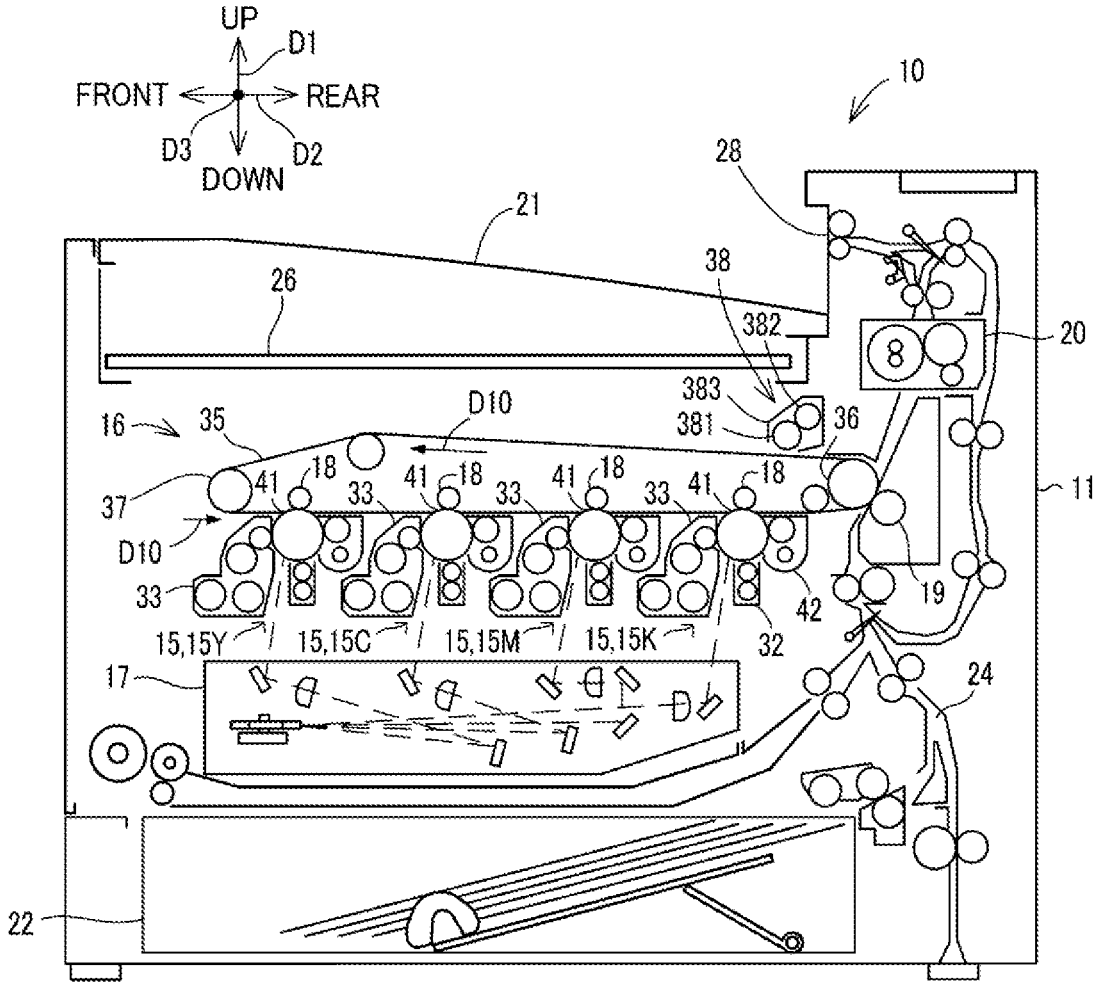
FIG. 2 is a cross-sectional diagram showing a configuration of an inside of the image forming apparatus.

As shown in FIG. 1 and FIG. 2, the image forming apparatus 10 includes a housing 11 (an example of an apparatus body according to the present disclosure). The housing 11 as a whole has an approximately rectangular parallelepiped shape. Multiple parts constituting the image forming apparatus 10 are provided inside of the housing 11.

As shown in FIG. 2, the image forming apparatus 10 includes a plurality of image forming units 15 (15Y, 15C, 15M, and 15K), an intermediate transfer unit 16, a laser scanning unit 17, a plurality of primary transfer rollers 18, a secondary transfer roller 19, a fixing device 20, a sheet tray 21, a sheet feeding cassette 22, a conveyance path 24, and a control substrate 26 that controls the parts of the image forming apparatus 10. In addition, as shown in FIG. 1, the image forming apparatus 10 includes a plurality of toner containers 3 (an example of a toner container according to the present disclosure) that are configured to be removably attached to an inner portion the housing 11.

The image forming apparatus 10 includes four image forming units 15. Each of the image forming units 15 is configured to electrophotographically form a toner image. The image forming unit 15 includes a photoconductor drum 41, a drum cleaning device 42, a charging device 32, and a developing device 33. It is noted that due to a lack of space, reference numerals for the charging devices 32 and the drum cleaning devices 42 have been partially omitted in FIG. 1.

As shown in FIG. 2, the image forming units 15 are juxtaposed along the front-rear direction D2 inside the housing 11, and are configured to form a color image by the so-called tandem-type method. Specifically, the image forming unit 15Y forms a yellow toner image. In addition, the image forming units 15C, 15M, and 15K respectively form a cyan, magenta, and black toner image. The image forming unit 15Y for yellow, the image forming unit 15C for cyan, the image forming unit 15M for magenta, and the image forming unit 15K for black are sequentially aligned from front to rear, along a traveling direction (indicated by an arrow D10) of a transfer belt 35 of the intermediate transfer unit 16.

The photoconductor drum 41 is formed in a cylindrical shape, and configured to hold a toner image that is developed by the developing device 33. The photoconductor drum 41 is rotatably supported by the housing 11 and the like.

In each of the image forming units 15, when the photoconductor drum 41 is uniformly charged to a specific potential by the charging device 32, the laser scanning unit 17, based on image data, irradiates laser light on the surface of the photoconductor drum 41. With this configuration, an electrostatic latent image is formed on the surface of the photoconductor drum 41. The electrostatic latent image is developed into a toner image (made into a visible image) by the developing device 33. The toner images of the multiple colors formed on the photoconductor drums 41 are sequentially transferred by the primary transfer rollers 18 to the transfer belt 35 to be superposed thereon. Next, the superposed color image is transferred by the secondary transfer roller 19 from the transfer belt 35 to a print sheet. The color image that has been transferred to the print sheet is then fixed thereto by the fixing device 20, and the print sheet is discharged to the sheet tray 21 via a sheet discharge port 28.

Each of the drum cleaning devices 42 uses a cleaning blade to remove toner that is remaining on the photoconductor drum 41 after primary transfer of the toner image. The drum cleaning device 42 is provided for each of the photoconductor drums 41, and disposed on a rear side of the photoconductor drum 41. An edge of the cleaning blade is disposed in contact with or near the surface of the photoconductor drum 41. When the photoconductor drum 41 rotates, the cleaning blade removes the used toner that is remaining on the surface of the photoconductor drum 41 after the transfer of the toner image. Since the removed toner becomes waste, the toner is generally referred to as waste toner. The drum cleaning device 42 includes a spiral member. The spiral member is a toner conveying member having a spirally-shaped wing around its shaft, and when the spiral member rotates, it conveys the waste toner that has been removed by the cleaning blade. The waste toner is conveyed toward one side (a right side according to the present embodiment) in an shaft direction (longitudinal direction) of the photoconductor drum 41.

As shown in FIG. 1, the plurality of toner containers 3 (3Y, 3C, 3M, 3K) are attached to the image forming apparatus 10. The plurality of toner containers 3 are attached in a righthand surface 11A (an example of a first surface according to the present disclosure) of the housing 11. In the present embodiment, four toner containers 3 are provided in the righthand surface 11A in a juxtaposed manner along the front-rear direction D2. The toner container 3Y is disposed at a frontmost position, and the toner container 3K for black is disposed at a rearmost position.

Figure 3:
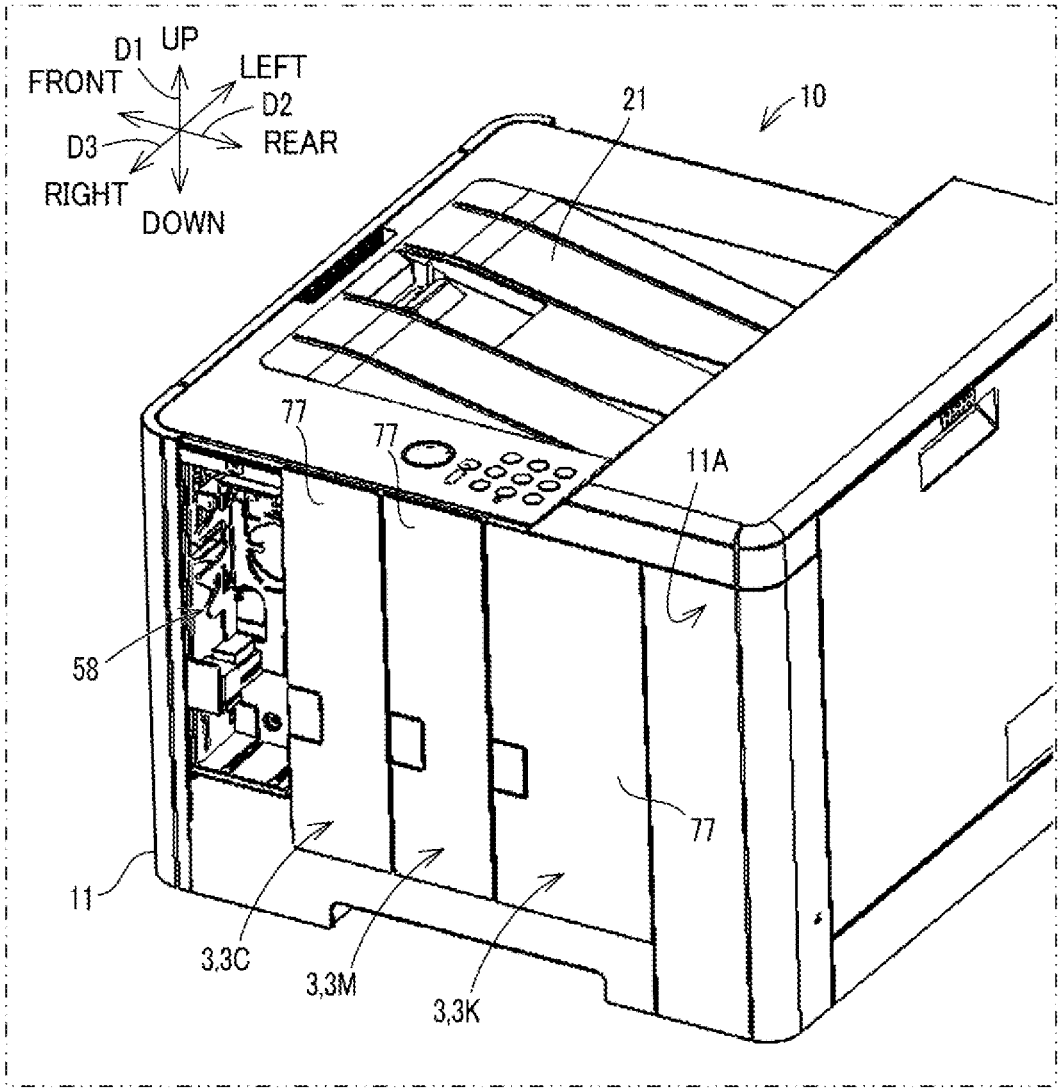
FIG. 3 is a perspective diagram showing the image forming apparatus viewed from its righthand side.

FIG. 3 is a perspective diagram of the image forming apparatus 10 viewed from its righthand side, in a state where the toner container 3Y disposed at the frontmost position has been removed. As shown in FIG. 3, on a portion of the housing 11 further inside the image forming apparatus 10 than the righthand surface 11A, an attachment portion 58 (an example of a container supporting portion according to the present disclosure) is provided for removably supporting the toner container 3. It is noted that although FIG. 3 only shows the attachment portion 58 to which the toner container 3Y is attached, the housing 11 is provided with a plurality of attachment portions 58 in correspondence to the plurality of toner containers 3.

Each of the toner containers 3 includes an upper storage portion 71 (first toner storage portion) and a lower storage portion 72 (second toner storage portion). The upper storage portion 71 includes a storage space for storing unused toner for replenishment. The lower storage portion 72 includes a storage space for storing the waste toner that is discharged from the drum cleaning device 42. When the toner container 3 is attached to the attachment portion 58, the unused toner is replenished from the upper storage portion 71 of the toner container 3 to inside the developing device 33. In addition, the waste toner that is discharged from the drum cleaning device 42 is guided through a discharge guide portion (not shown) to the lower storage portion 72 of the toner container 3 to be stored therein.

As shown in FIG. 3, the four toner containers 3 are attached in the righthand surface 11A of the housing 11 on a righthand side of the image forming units 15. The toner containers 3 are aligned along the front-rear direction D2 inside the righthand surface 11A of the housing 11. The toner containers 3 are described in further detail below.

As shown in FIG. 2, the intermediate transfer unit 16 is provided above the four image forming units 15, and more specifically, on top of the four photoconductor drums 41. The intermediate transfer unit 16 includes the transfer belt 35, a driving roller 36, a driven roller 37, and a belt cleaning device 38. It is noted that the primary transfer rollers 18 are supported on a frame (not shown) of the intermediate transfer unit 16.

The transfer belt 35 is an annular belt member that is stretched across the driving roller 36 and the driven roller 37 in the front-rear direction D2. The image forming units 15 are aligned along the transfer belt 35 in the front-rear direction D2. The transfer belt 35 holds, on its surface, toner images that have been primarily transferred thereto from the photoconductor drums 41. When the transfer belt 35 is rotationally driven and travels in the direction indicated by the arrow D10, the toner images of the multiple colors that are held on the photoconductor drums 41 are sequentially transferred to the transfer belt 35 to be superposed thereon.

The belt cleaning device 38 is provided near the fixing device 20. Specifically, the belt cleaning device 38 is provided above the transfer belt 35 and toward a rear side of the housing 11. The image forming unit 15K for black is disposed below the belt cleaning device 38. That is, among the plurality of image forming units 15, the image forming unit 15K for black is provided closest to the belt cleaning device 38.

The belt cleaning device 38 removes the used toner remaining on the surface of the transfer belt 35, and conveys, via a toner discharge path of the drum cleaning device 42 for black, the used toner that has been removed (hereinafter referred to as "waste toner") toward the lower storage portion 72 of the toner container 3K. The belt cleaning device 38 includes, stored inside a housing 383 (see FIG. 2), a cleaning roller 381 elongated in the left-right direction D3, and a spiral member 382 for conveying the waste toner. The cleaning roller 381 removes the used toner remaining on the surface of the transfer belt 35 by rotating while in contact with the surface of the transfer belt 35. The used toner that has been removed (waste toner) is conveyed in one direction by rotation of the spiral member 382. Specifically, the waste toner is conveyed toward one side (the righthand side in the present embodiment) of a width direction (the same direction as the left-right direction D3) of the transfer belt 35.

In the belt cleaning device 38, the waste toner that has been conveyed by the spiral member 382 to a right-end portion of the housing 383, is guided via the toner discharge path (not shown) to inside the lower storage portion 72 of the toner container 3K to be stored therein.

Meanwhile, in a conventional image forming apparatus, a cover attached to its top surface or side surface is removed when replacing the toner container 3. The cover is rotatably supported on the apparatus body by a hinge or the like, and thus the cover must be rotatable about the hinge, like a door. In this case, space for installing the image forming apparatus is limited, since it is necessary to secure, around the top surface or side surface of the apparatus body, a large enough space in which the cover can be rotated when replacing the toner container 3.

As a solution to this issue, in the image forming apparatus 10 according to the present embodiment, an exterior panel 77 is provided on the toner container 3, and the attachment portion 58 is configured as described below. With this configuration, it is possible to make smaller, in comparison to what is necessary for the conventional apparatus, the space necessary for replacing the toner container 3, and improve a degree of freedom of installation of the image forming apparatus 10.

Below, as a representative example of the four toner containers 3, the configuration of the toner container 3Y for yellow will be described. It is noted that since the toner containers 3C and 3M have the same configuration as the toner container 3Y, and the toner container 3K has the same configuration as the toner container 3Y except that the toner container 3K has a larger volume, detailed descriptions of the toner containers 3C, 3M, and 3K are omitted.

Figure 4:
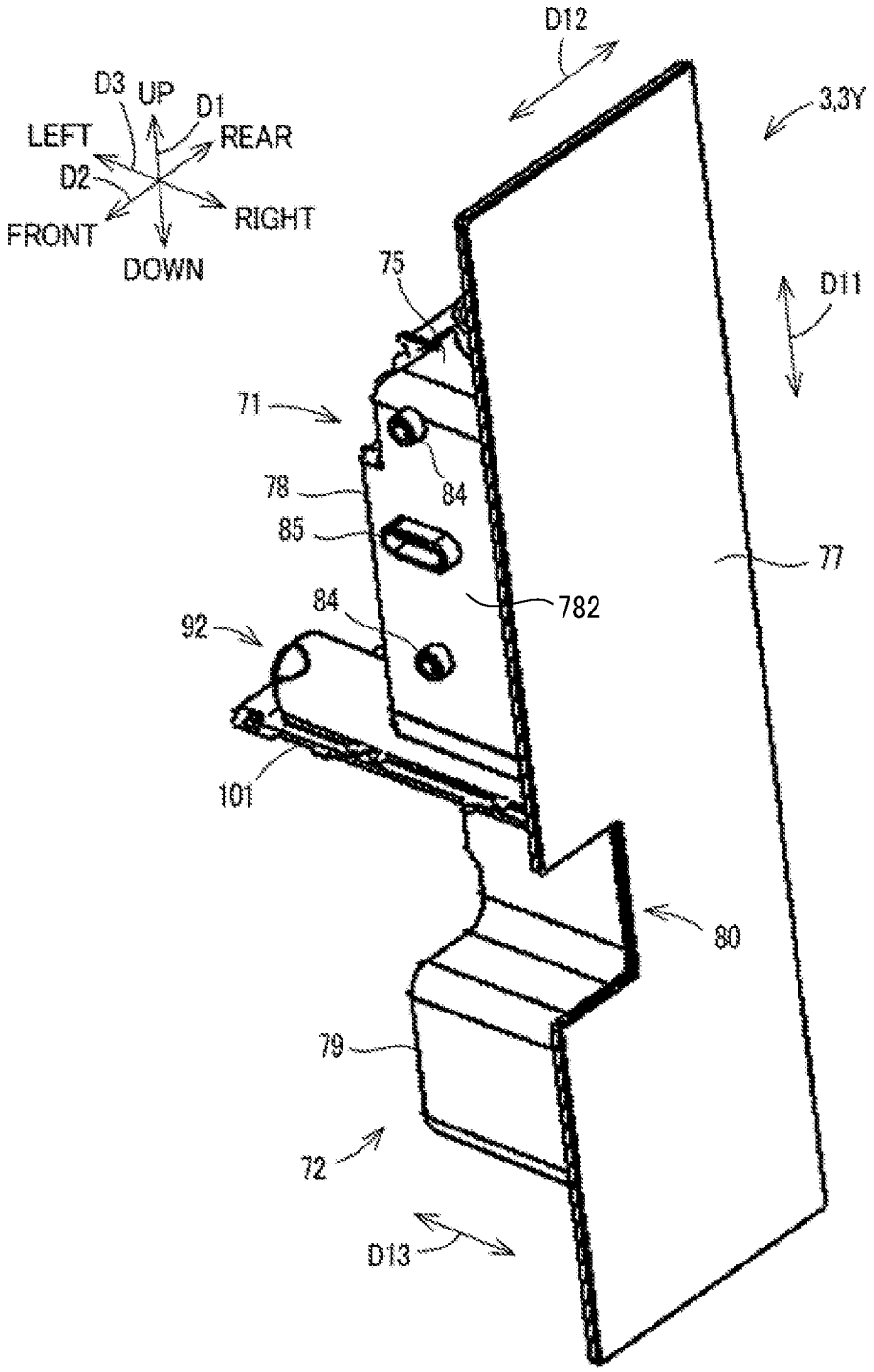
FIG. 4 is a perspective diagram showing a toner container viewed from its exterior panel side.
Figure 5:
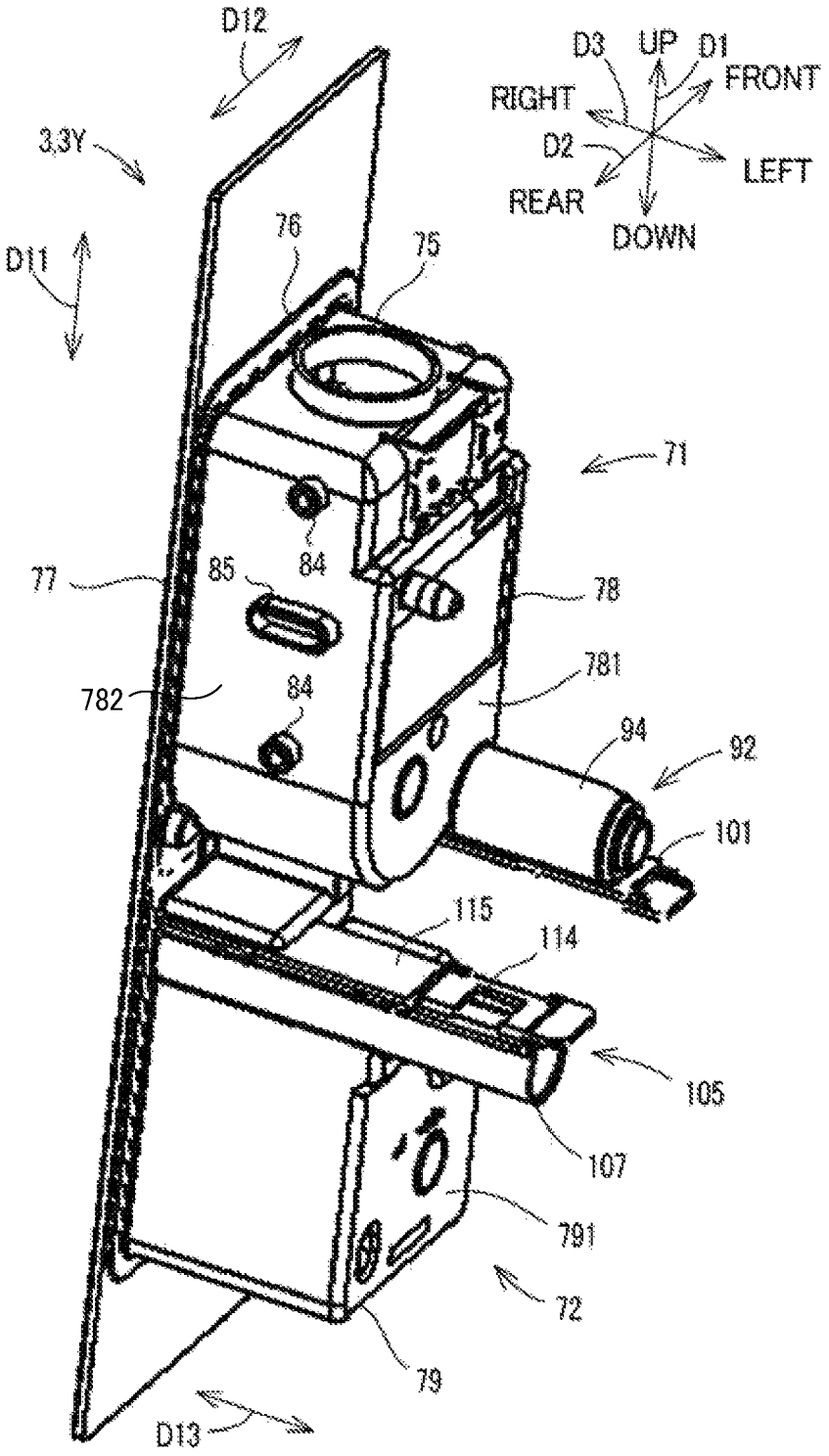
FIG. 5 is a perspective diagram showing the toner container viewed from its container body side.

FIG. 4 is a perspective diagram of the toner container 3Y viewed from its exterior panel 77 side. FIG. 5 is a perspective diagram of the toner container 3 viewed from its container body 75 side. It is noted that FIG. 4 and FIG. 5 indicate the up-down direction D1, front-rear direction D2, and left-right direction D3 with reference to an attached attitude of the toner container 3Y when it is attached to the attachment portion 58 (see FIG. 3). In addition, on a basis that the toner container 3Y is in the attached attitude, the following description defines the up-down direction D1 as a height direction D11 of the toner container 3Y, the front-rear direction D2 as a width direction D12 of the toner container 3Y, and the left-right direction D3 as depth direction D13 of the toner container 3Y.

As shown in FIG. 4 and FIG. 5, the toner container 3Y includes the container body 75. The container body 75 is a resin molding obtained by injection-molding of synthetic resin. The container body 75 is formed elongated in the height direction D11, wide in the width direction D12, and shallow in the depth direction D13.

The container body 75 includes an upper case 78 (first housing) formed on its upper side, a lower case 79 (second housing) formed on its lower side, a lid body 76 (lid member), and the exterior panel 77 (an example of an exterior member according to the present disclosure). That is, the upper case 78 is formed on one side (the upper side) of the container body 75 in the height direction D11 (longitudinal direction), and the lower case 79 is formed on the other side (the lower side) of the container body 75 in the height direction D11 (longitudinal direction).

An opening portion is formed on a righthand surface of the upper case 78, and an opening portion is formed on a righthand surface of the lower case 79. The opening portions are formed on the same plane as one another. A flange is formed along the edges of the opening portions. The opening portions are closed with the flat-shaped lid body 76 (see FIG. 5). For example, the lid body 76 and the flange may be welded to one another. The upper storage portion 71 including the storage space for storing the unused toner is formed by closing the opening portion on the upper case 78 with the lid body 76. In addition, the lower storage portion 72 including the storage space for storing the waste toner is formed by closing the opening portion on the lower case 79 with the lid body 76.

As shown in FIG. 4 and FIG. 5, the upper storage portion 71 includes a first conveyance portion 92. The first conveyance portion 92 includes a tubular first conveyance guide portion 94 that extends outward from a wall surface 781 on a left side the upper case 78, and a spiral member (not shown) that is a toner conveying member provided inside the first conveyance guide portion 94. The first conveyance guide portion 94 is formed integrally with the upper case 78, and is formed in a cylindrical shape having the same center of rotation as the spiral member. Here, the wall surface 781 is positioned on one side of the toner container 3Y in the depth direction D13, and faces the attachment portion 58 when the toner container 3Y is attached. It is noted that the depth direction D13 is the same as an attachment-removal direction of the toner container 3Y to and from the attachment portion 58.

The spiral member includes a spirally-shaped wing around its rotational shaft, and is rotatably provided inside the first conveyance guide portion 94. An input portion for receiving rotational driving force that is input from an external source, is formed integrally with an end portion of the rotational shaft. The spiral member rotates by receiving the rotational driving force from the input portion. With this rotation, the spiral member conveys, through the first conveyance guide portion 94, the unused toner stored inside the upper storage portion 71 toward an attachment portion 58 side (see FIG. 4) of the first conveyance guide portion 94, and guides the unused toner from the toner discharge port (not shown) to the developing device 33.

In addition, on a bottom surface of the first conveyance guide portion 94, a shutter member 101 (opening/closing member) is provided for opening and closing the toner discharge port. The shutter member 101 is supported by the first conveyance guide portion 94 in a way that it is slidable along the bottom surface of the first conveyance guide portion 94 in a longitudinal direction of the first conveyance guide portion 94. When the toner container 3Y is attached to the attachment portion 58 (see FIG. 3), the shutter member 101 is moved from a closed position where it closes off the toner discharge port, to an open position where it opens the toner discharge port. With this configuration, the toner discharge port and the replenishment port of the developing device 33 are connected, and it is possible to replenish toner from the toner discharge port to the replenishment port.

As shown in FIG. 5, the lower storage portion 72 includes a second conveyance portion 105. The second conveyance portion 105 conveys, to the inside of the lower storage portion 72, waste toner that has been discharged from the drum cleaning device 42 for yellow. The second conveyance portion 105 includes a cylindrical second conveyance guide portion 107 that extends outwards from a wall surface 791 on a left side of the lower case 79, and a spiral member (not shown) that is a toner conveying member provided inside the second conveyance guide portion 107. The second conveyance guide portion 107 is formed integrally with the lower case 79, and is formed in a cylindrical shape having the same center of rotation as the spiral member.

The spiral member is a conveying member for conveying, to the lower storage portion 72 via second conveyance guide portion 107, the waste toner that has been discharged from the drum cleaning device 42. In addition to receiving the waste toner from the drum cleaning device 42, the second conveyance guide portion 107 is a guide member for guiding, to the inside of the lower storage portion 72, the waste toner that is conveyed by the spiral member.

The spiral member includes a spirally-shaped wing around its rotational shaft, and is rotatably provided inside the second conveyance guide portion 107. An input portion for receiving rotational driving force that is input from an external source is formed integrally with an end portion of the rotational shaft. The spiral member rotates by receiving the rotational driving force from the input portion. With this rotation, the spiral member conveys the waste toner inside the second conveyance guide portion 107 toward the inside of the lower storage portion 72.

In addition, a toner inlet port 114 for guiding waste toner to the inside of the second conveyance guide portion 107 is formed on an upper surface of the second conveyance guide portion 107. In addition, on the upper surface of the second conveyance guide portion 107, a shutter member 115 is formed for opening and closing the toner inlet port 114. The shutter member 115 is supported by the second conveyance guide portion 107 in a way that it is slidable along the upper surface of the second conveyance guide portion 107 in a longitudinal direction of the second conveyance guide portion 107. When the toner container 3Y is attached to the attachment portion 58 (see FIG. 3), the shutter member 115 is moved from a closed position where it closes off the toner inlet port 114, to an open position where it opens the toner inlet port 114. With this configuration, the toner inlet port 114 and the toner discharge port of the drum cleaning device 42 are connected, and waste toner can be guided from the toner discharge port to the toner inlet port 114.

As shown in FIG. 4, the exterior panel 77 is a substantially rectangular flat-shaped member that is elongated in the height direction D11. The exterior panel 77 is made by the same material as the housing 11 of the image forming apparatus 10, and may have the same color as the housing 11. The exterior panel 77 is formed to be larger than the lid body 76 in size (see FIG. 5), and is attached to an outer surface of the lid body 76. In the present embodiment, as shown in FIG. 3, when the toner container 3Y is attached to the attachment portion 58, the exterior panel 77 of the toner container 3Y constitutes a part of an exterior of the righthand surface 11A of the housing 11.

A rectangular cutout 80 is formed in a side portion on one side of the exterior panel 77 in the width direction D12 (a side portion toward the front). The cutout 80 is a portion in which a push surface portion 691 of an operation member 69 that is described later, is disposed. When the toner container 3Y is attached to the attachment portion 58, the push surface portion 691 is disposed on the same plane as an outer surface of the exterior panel 77, and constitutes a part of the exterior of the righthand surface 11A of the housing 11.

As shown in FIG. 4 and FIG. 5, the upper case 78 has two side surfaces 782 in the width direction D12, and two protruding bosses 84 separated from one another in the height direction D11 are formed on each of the side surfaces 782. The protruding boss 84 is an example of a lock piece according to the present disclosure. The protruding bosses 84 are formed integrally with the upper case 78. Two protruding bosses 84 are formed on the side surface 782 on a front side, and two protruding bosses 84 are formed on the side surface 782 on a rear side. When the toner container 3Y is attached to the attachment portion 58 at a specific attachment position, the protruding bosses 84 become locked in the attachment-removal direction of the toner container 3Y to and from the attachment portion 58. Specifically, when the toner container 3Y is attached to the attachment portion 58, each of the protruding bosses 84 is hooked on a lock groove 657 of a hook 652 that is included in a movement frame 65 described below, and the protruding boss 84 is locked in the attachment-removal direction. It is noted that the attachment-removal direction is perpendicular to the righthand surface 11A of the housing 11, the same direction as the left-right direction D3, and an example of a first direction according to the present disclosure.

In addition, an elongated boss 85 that is elongated in the depth direction D13 is formed protruding from each of the side surfaces 782. The elongated boss 85 is formed on each side surface 782 at an approximately intermediate position between the two protruding bosses 84 that are separated from one another in the height direction D11. That is, one elongated boss 85 is formed on the side surface 782 on the front side, and one elongated boss 85 is formed on the side surface 782 on the rear side. The elongated bosses 85 are for determining a position, in the up-down direction D1, where the toner container 3Y is attached to the attachment portion 58, when the toner container 3Y is attached to the attachment portion 58 at the specific attachment position. Specifically, when the toner container 3Y is attached to the attachment portion 58, the position of the elongated boss 85 in the up-down direction D1 is determined by inserting each of the elongated bosses 85 in a position-determining groove 614 that is included in a support frame 61 described below.

In the following, a configuration is described of the attachment portion 58 for attaching the toner container 3. It is noted that in the present embodiment, four attachment portions 58 are provided in correspondence to the four toner containers 3, and the four attachment portions 58 have the same configuration.

Figure 6:
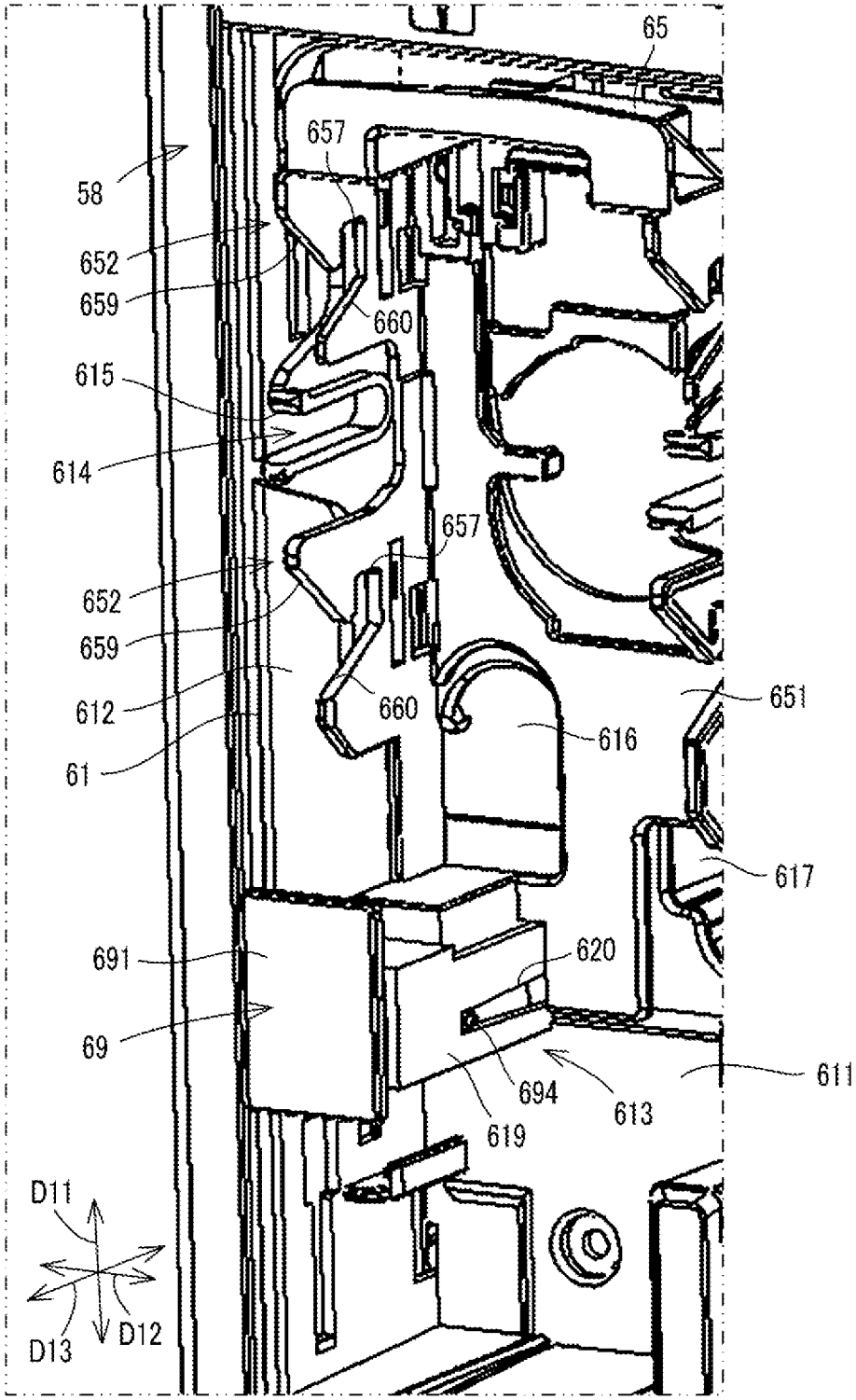
FIG. 6 is an enlarged perspective diagram showing an attachment portion of the toner container.
Figure 7:
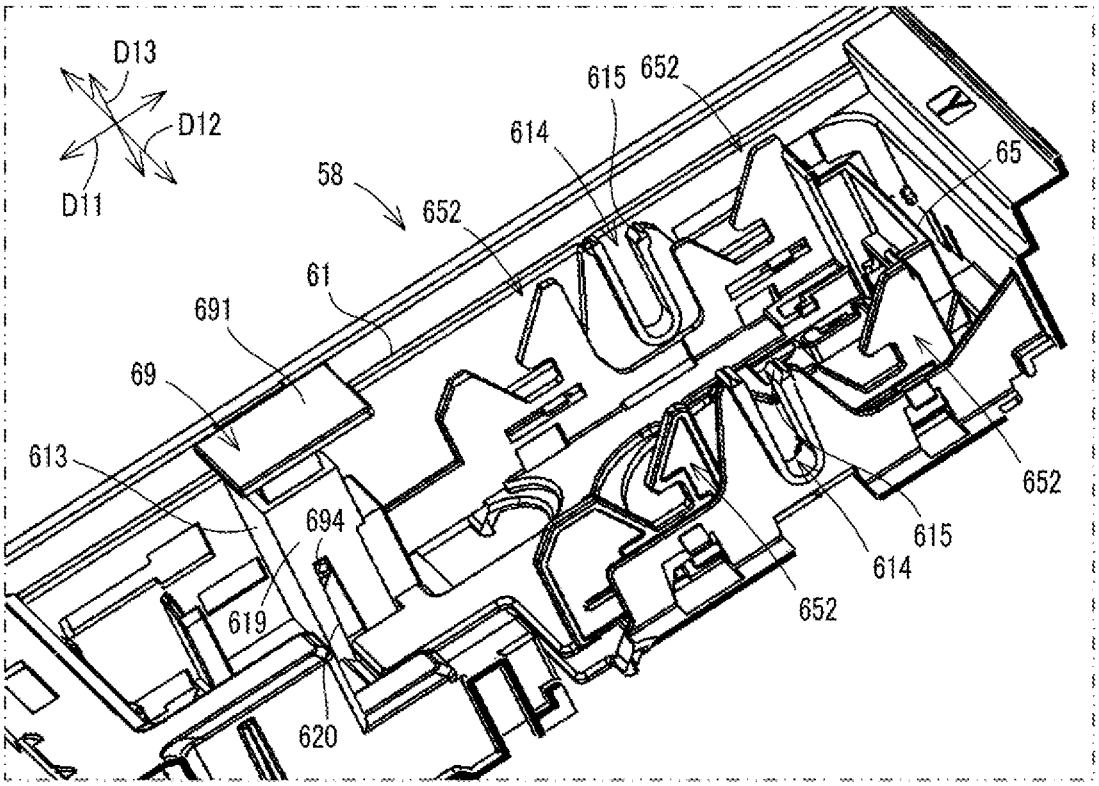
FIG. 7 is a perspective diagram showing a movement member of the toner container in a state where the movement member is disposed at a locked position.
Figure 8:
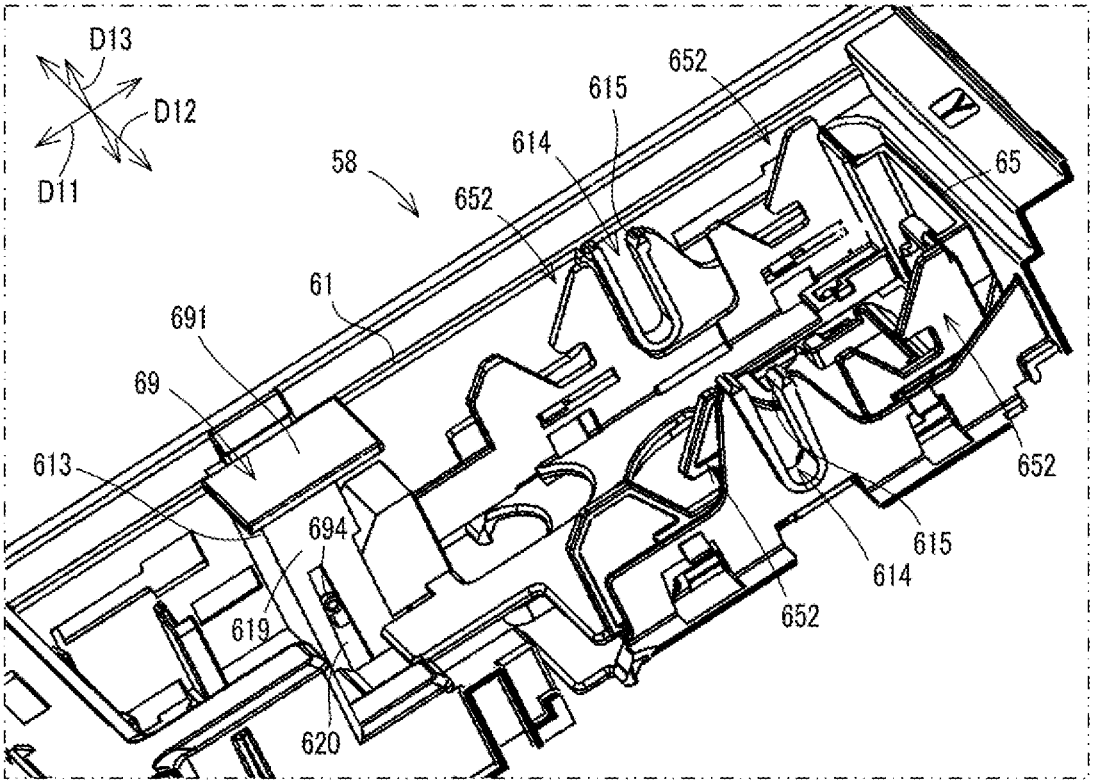
FIG. 8 is a perspective diagram showing the movement member of the toner container in a state where the movement member is disposed at an unlocked position.

FIG. 6 is an enlarged perspective diagram of the attachment portion 58 of the toner container 3. FIG. 7 is a perspective diagram of the movement frame 65 that is included in the attachment portion 58, wherein the movement frame 65 is in a state where it is disposed at a locked position. FIG. 8 is a perspective diagram of the movement frame 65 disposed at an unlocked position.

Figure 15:
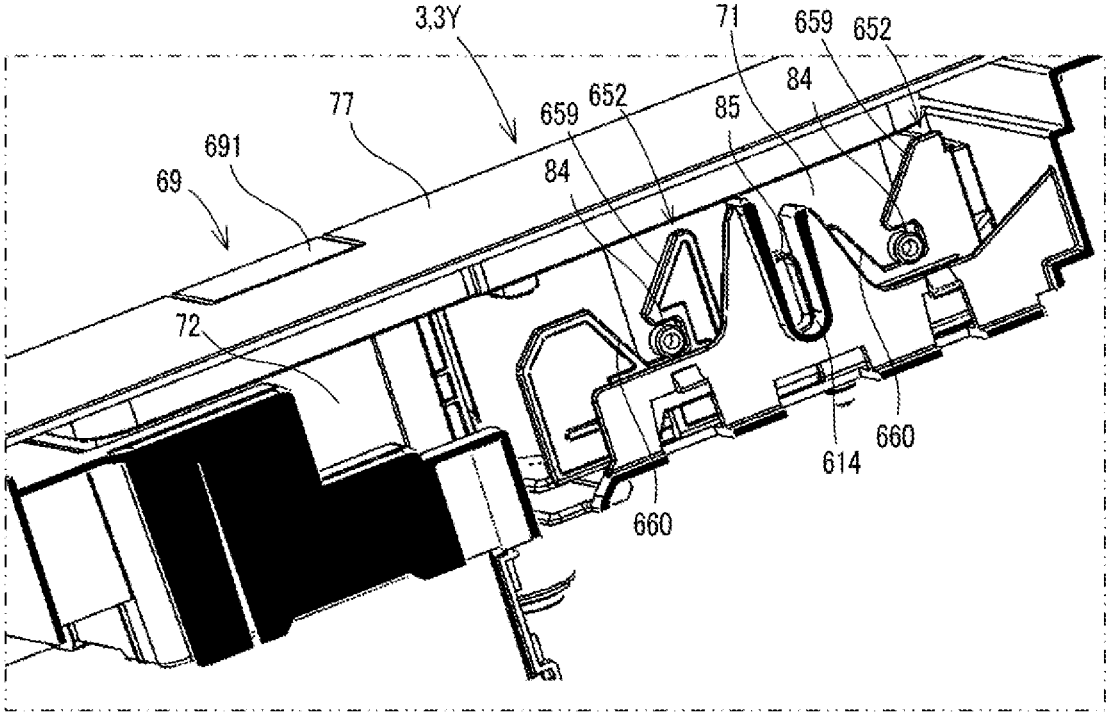
FIG. 15 is a perspective diagram showing the toner container disposed at an attachment position.

The attachment portion 58 supports the toner container 3 such that it is movable between an attachment position and a pull-out position, wherein the attachment position is specified at an inner side of the righthand surface 11A of the housing 11, and the pull-out position is separated from the attachment position toward the righthand surface 11A by a specific distance. The attachment position is the position of the toner container 3 shown in FIG. 15, and the pull-out position is the position of the toner container 3 shown in FIG. 16.

As shown in FIG. 6, the attachment portion 58 includes the support frame 61 (an example of a support member according to the present disclosure), the movement frame 65 (an example of a movement member according to the present disclosure), a coil spring 68 (an example of an elastic member according to the present disclosure), and the operation member 69. The members listed above are, for example, made of synthetic resin.

Figure 9:
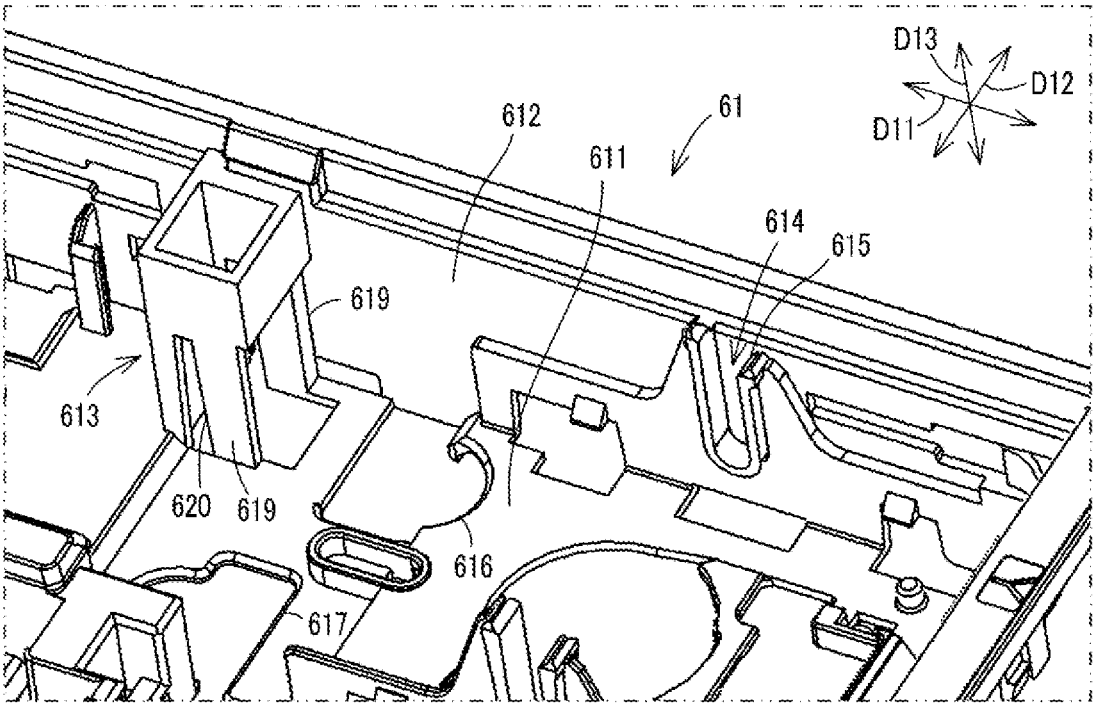
FIG. 9 is a partially enlarged diagram showing a supporting frame of the attachment portion of the toner container.

The support frame 61 is fixed on an inner frame of the housing 11. The support frame 61 supports the toner container 3 such that it is movable between the attachment position and the pull-out position. FIG. 9 shows a configuration of the support frame 61 in a state where the movement frame 65 and the operation member 69 have been removed from the attachment portion 58. As shown in FIG. 9, the support frame 61 includes a bottom plate 611 on which the movement frame 65 is disposed, two side plates 612 that each stand from one of two ends in the width direction D12 of the bottom plate 611, and a holder 613 that is a rectangular tube protruding from the bottom plate 611.

Figure 14:
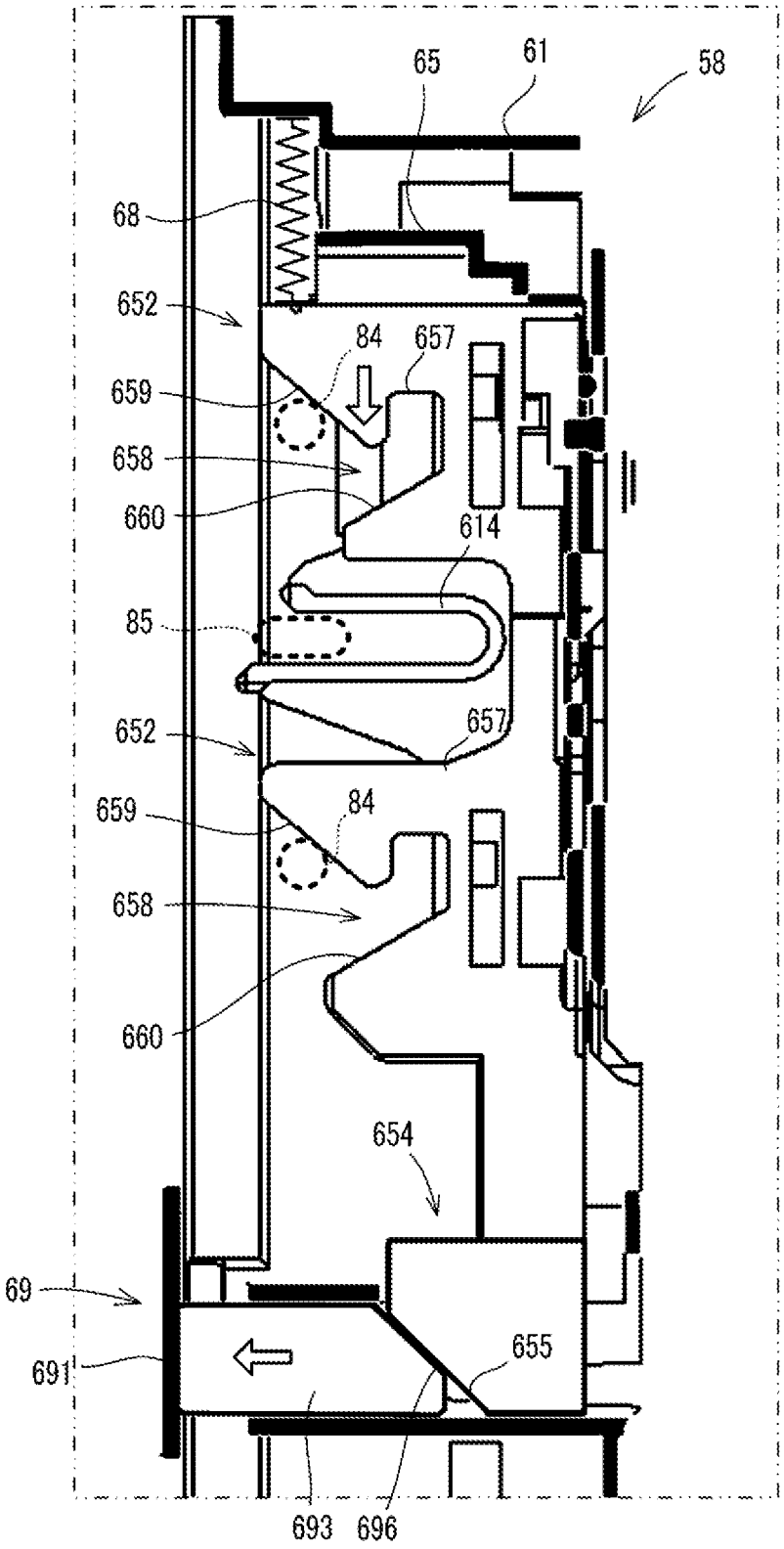
FIG. 14 is a side-view diagram showing the engagement relationship between the operation member and the cams, in a state where the operation member has returned to the first position.

The position-determining groove 614, in which the elongated boss 85 of the toner container 3 is inserted, is formed integrally with an inner surface of the side plate 612. The position-determining groove 614 extends in the depth direction D13, and includes an opening 615 on its end portion in a direction extending away from the bottom plate 611 (upwards in FIG. 9). When the toner container 3 is attached to the attachment portion 58, the elongated boss 85 is inserted in the position-determining groove 614 from the opening 615. With this configuration, the elongated boss 85 is guided along an extending direction of the position-determining groove 614, and the toner container 3 can be moved between the attachment position (indicated in FIG. 14) and the pull-out position. The elongated boss 85 is disposed on an inward side of the position-determining groove 614 at the attachment position, and at the pull-out position, the elongated boss 85 is disposed more toward the opening 615 side than when the toner container 3 is at the attachment position.

By inserting the elongated boss 85 in the position-determining groove 614, the position of the elongated boss 85 in the up-down direction D1 is determined, and in addition, a position of the toner container 3 in the up-down direction D1 is determined. It is noted that an opening 616 and an opening 617 are formed in the bottom plate 611, and when the toner container 3 is attached, the first conveyance portion 92 is inserted in the opening 616, and the second conveyance portion 105 is inserted in the opening 617.

The holder 613 holds the operation member 69. A guide groove 620 that extends in the depth direction D13 is formed on each of two side walls 619 that are formed on two side portions in the width direction D12 of the holder 613. By inserting, in the guide groove 620, a guide pin 694 (see FIG. 10) included in the operation member 69, the operation member 69 is supported movably in the depth direction D13 by the holder 613.

Figure 10:
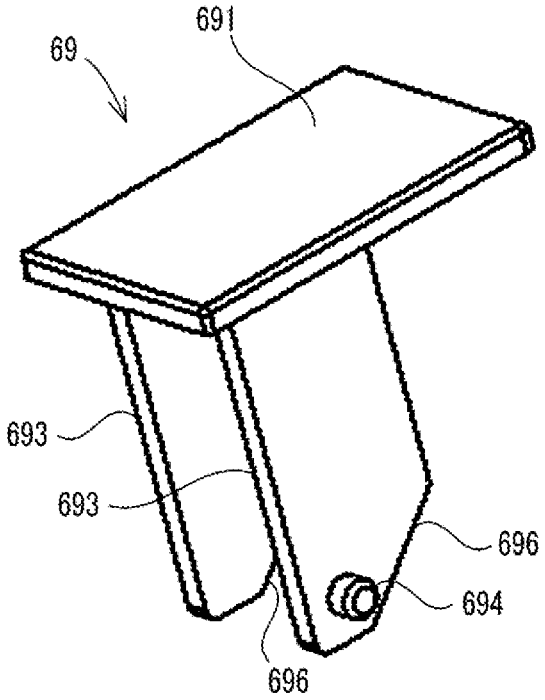
FIG. 10 is an enlarged perspective diagram showing an operation member for removing the toner container.

The operation member 69 is attached to the holder 613. FIG. 10 is an enlarged perspective diagram showing the operation member 69 for removing the toner container 3. As shown in FIG. 10, the operation member 69 includes the push surface portion 691 having a push surface that is pushed by a user, a pair of push arms 693 that extend perpendicularly from the push surface portion 691, and a guide pin 694 that is provided on an outer side of each of the push arms 693. As described above, the push surface portion 691 is disposed on the same plane as the outer surface of the exterior panel 77, and constitutes a part of the exterior of the righthand surface 11A of the housing 11. Accordingly, the push surface portion 691 is made of the same material as the housing 11 of the image forming apparatus 10, and may have the same color as the housing 11.

The push arms 693 of the operation member 69 are inserted inside the holder 613 from an opening that is formed on a protruding end of the holder 613, and the guide pin 694 is inserted into the guide groove 620. This allows for the operation member 69 to be supported movably in the depth direction D13 by the holder 613.

Figure 12:
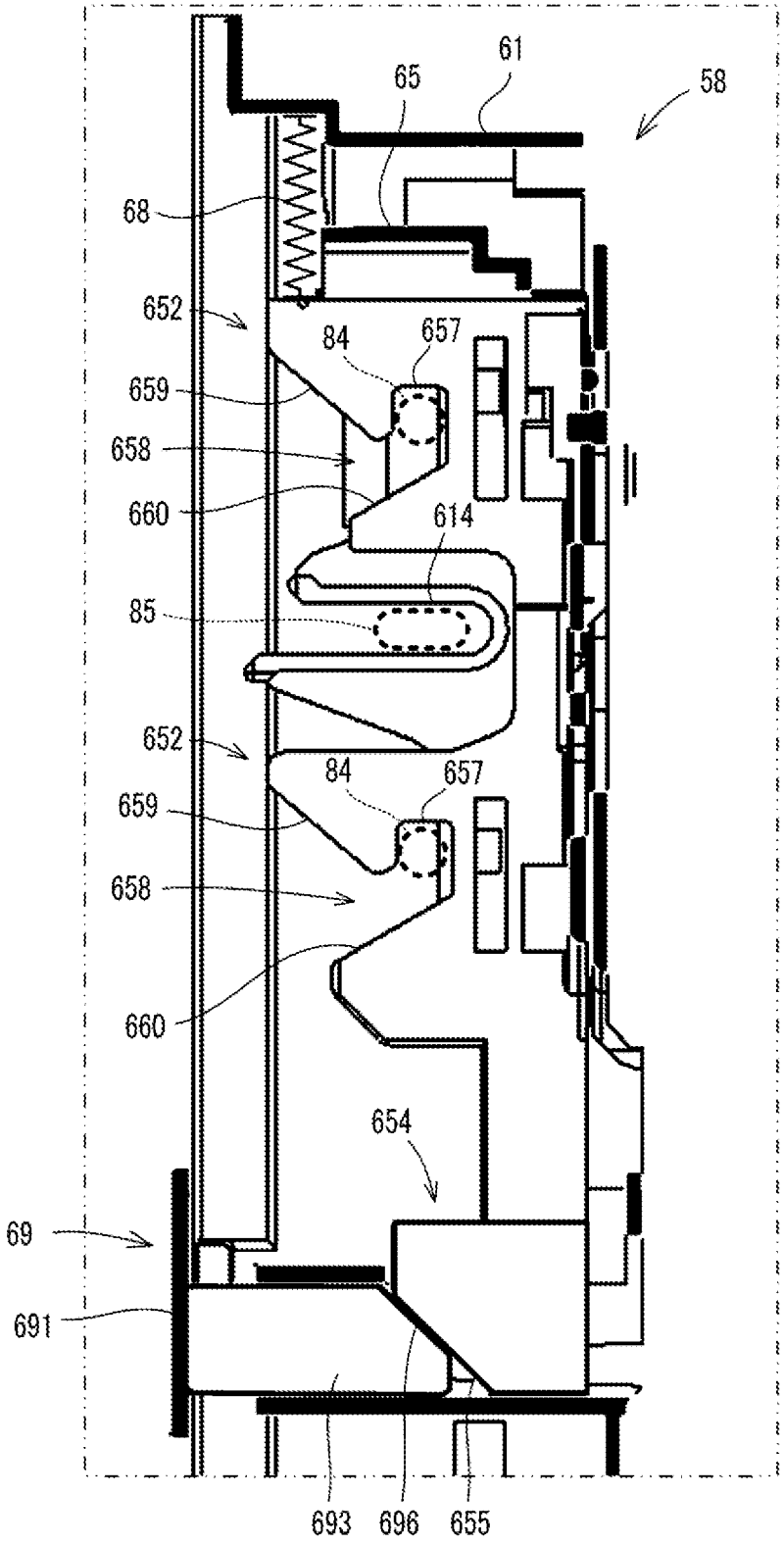
FIG. 12 is a side-view diagram showing an engagement relationship between the operation member and a plurality of cams, in a state where the operation member is disposed at a first position.
Figure 13:
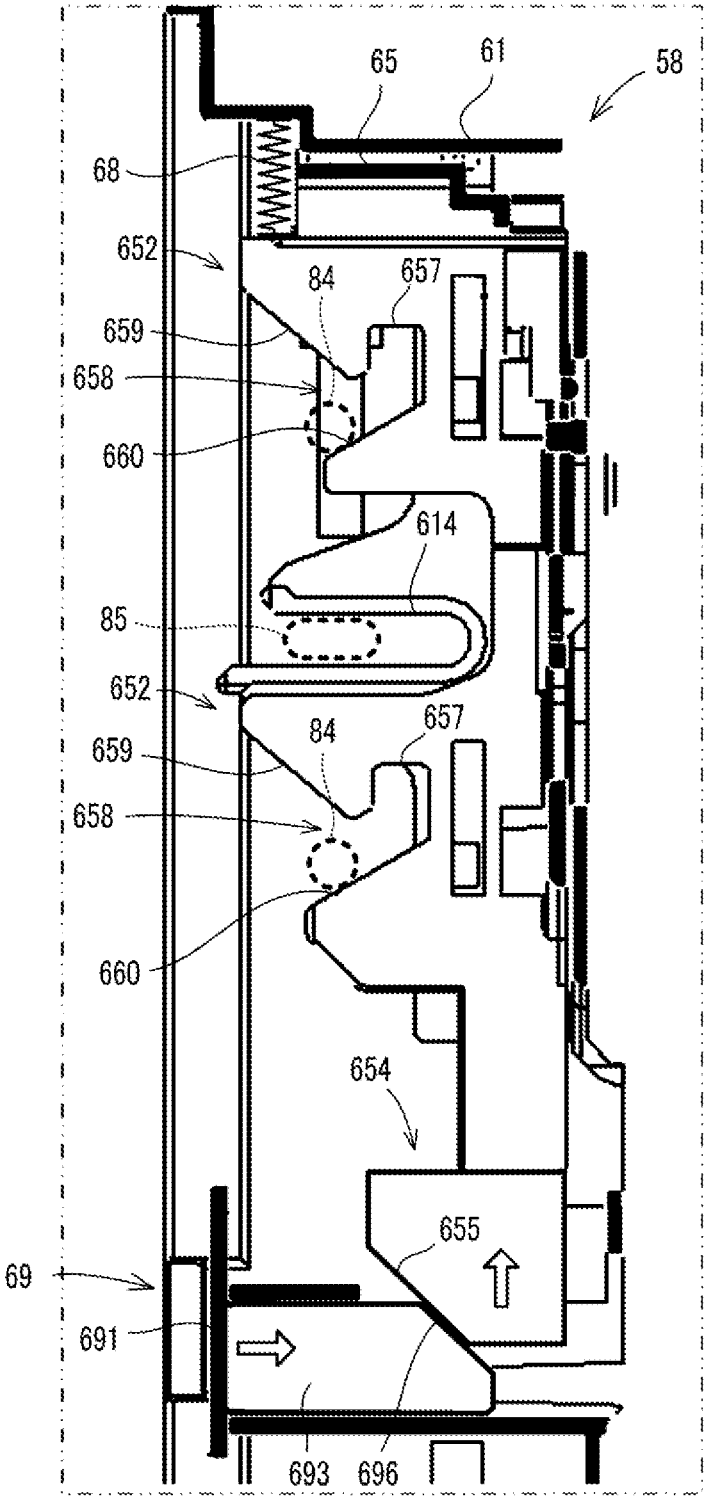
FIG. 13 is a side-view diagram showing the engagement relationship between the operation member and the cams, in a state where a pushing operation on the operation member has pushed the operation member to a second position.

In the present embodiment, the operation member 69 is supported such that it is movable between a first position and a second position. Here, when the operation member 69 is at the first position as shown in FIG. 7 and FIG. 12, the movement frame 65 is at the locked position, and an inclined surface 696 on each of the push arms 693 comes in contact with an inclined cam 655 of a first cam 654 that is described below. In addition, the second position, as shown in FIG. 8 and FIG. 13, is further inside the holder 613 than the first position, and at the second position, the first cam 654 and the movement frame 65 are moved to the unlocked position.

As shown in FIG. 6, the movement frame 65 is provided on the support frame 61. The movement frame 65 is supported on the support frame 61 such that the movement frame 65 is slidable in the height direction D11. The height direction D11 is the same direction as the up-down direction D1 in a state where the toner container 3 is attached to the attachment portion 58, and is equivalent to a second direction according to the present disclosure that extends along the righthand surface 11A of the housing 11.

The movement frame 65 is movable between the locked position shown in FIG. 7, and the unlocked position (release position) on the support frame 61, as shown in FIG. 8. In the locked position, the protruding boss 84 of the toner container 3 is locked in the depth direction D13. In addition, at the unlocked position, the protruding boss 84 is unlocked and can move in the depth direction D13.

Figure 11:
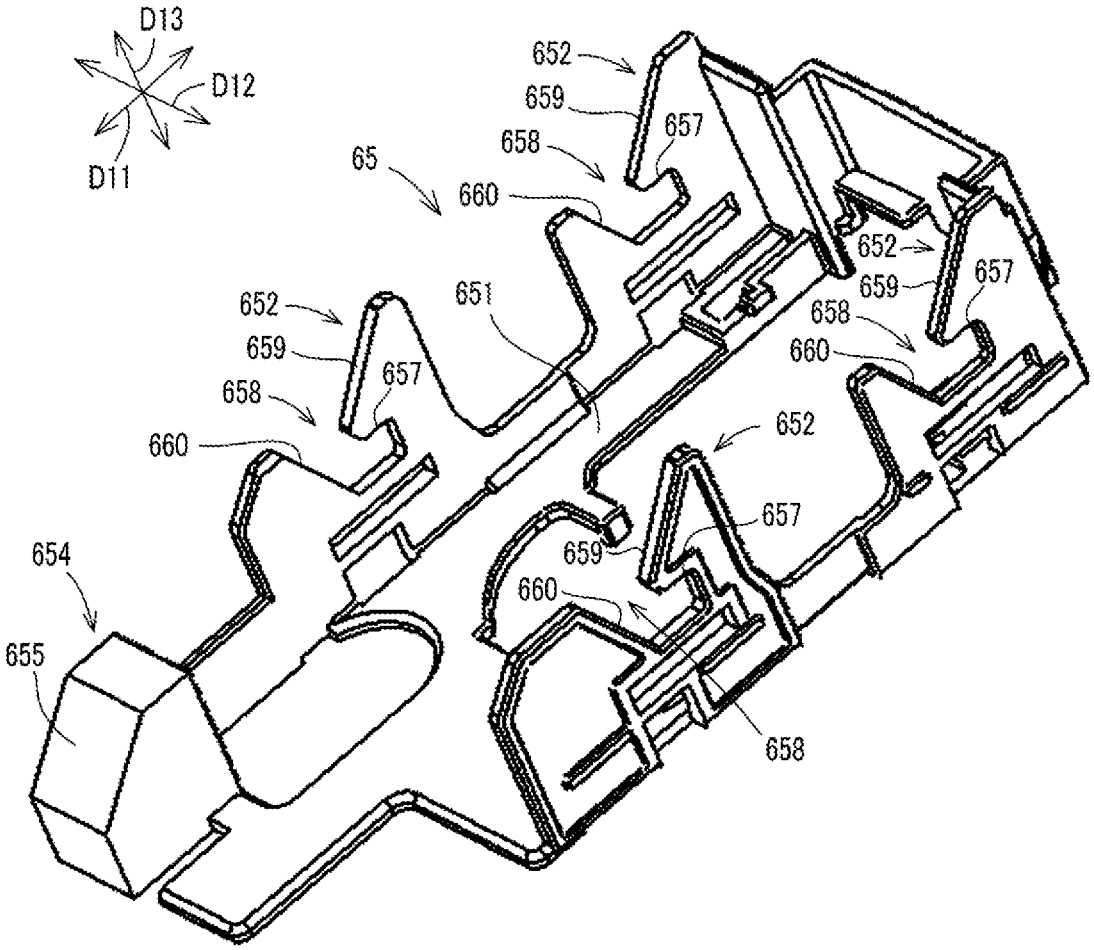
FIG. 11 is a perspective diagram showing a movement frame of the attachment portion of the toner container.

FIG. 11 is a perspective diagram showing the movement frame 65 of the attachment portion 58. As shown in FIG. 11, the movement frame 65 includes a base plate 651 that is disposed opposite from the bottom plate 611 of the support frame 61, and two hooks 652 formed in a downward facing hook-shape, that each stand and protrude from one of two ends in the width direction D12 of the base plate 651. Multiple openings are formed in the base plate 651 as appropriate, so that parts of the toner container 3 such as the first conveyance portion 92 and the second conveyance portion 105 can be inserted therein.

In the present embodiment, four hooks 652 are provided in the movement frame 65. The hooks 652 are provided at positions where they engage in the depth direction D13 with the four protruding bosses 84 of the toner container 3, when the toner container 3 is attached to the attachment portion 58.

In addition, the first cam 654 (an example of a first pushing member according to the present disclosure) is formed integrally with the movement frame 65. The first cam 654 pushes the movement frame 65 from the locked position (shown in FIG. 7) to the unlocked position (shown in FIG. 8), in response to a pushing operation on the operation member 69 toward a position that is further inside the housing 11 than the righthand surface 11A. Although the first cam 654 and the movement frame 65 are formed integrally in the present embodiment, the first cam 654 may be formed independently from the movement frame 65 as a separate member.

Specifically, the first cam 654 includes the inclined cam 655 having an inclined surface. When the pushing operation causes the operation member 69 to come in contact with the first cam 654, the inclined surface receives a pushing force in the depth direction D13 from the operation member 69, and converts the pushing force to a force in a direction (the height direction D11) that extends toward the unlocked position. An inclined angle of the inclined cam 655 is 45 degrees. When the push arms 693 of the operation member 69 are pushed further inward from their positions (shown in FIG. 12) where they come in contact with the inclined surface of the inclined cam 655, the pushing force from the push arms 693 causes the movement frame 65 to move from the locked position toward the unlocked position, as shown in FIG. 13.

In the present embodiment, the coil spring 68 is provided in the attachment portion 58. When no other external forces are applied to the movement frame 65, the coil spring 68 elastically actuates the movement frame 65 toward the locked position. As shown in FIG. 12, the coil spring 68 is interposed in a compressed state between an upper wall of the support frame 61 and an upper wall of the movement frame 65. With this configuration, when no other external forces are applied to the movement frame 65, the movement frame 65 is held at the locked position.

As shown in FIG. 11, the hooks 652 each include the lock groove 657, in which the protruding boss 84 is inserted when the toner container 3 is attached. The lock groove 657 extends in the height direction D11. A third cam 659 (an example of a third pushing member according to the present disclosure) is formed on a protruding end of each of the hooks 652. The third cam 659 is inclined at a 45-degree angle toward an opening 658 of the lock groove 657. When the toner container 3 is in a removed state from the attachment portion 58, and the toner container 3 is inserted in the attachment portion 58 in an attachment direction, the third cam 659 comes in contact with the protruding boss 84. When the third cam 659 is in contact with the protruding boss 84, and the toner container 3 is inserted further in the attachment direction, a pushing force received from the protruding boss 84 is converted by the third cam 659 into a force that causes the movement frame 65 to move to the unlocked position. With this configuration, the movement frame 65 moves from the locked position to the unlocked position against an actuating force from the coil spring 68, and the protruding boss 84 enters the lock groove 657 from the opening 658. When the protruding boss 84 enters the lock groove 657, the movement frame 65 returns from the unlocked position to the locked position by the actuating force from the coil spring 68 (see FIG. 12 and FIG. 15). At this time, the protruding boss 84 is locked in the depth direction D13 by the hook 652.

Figure 16:
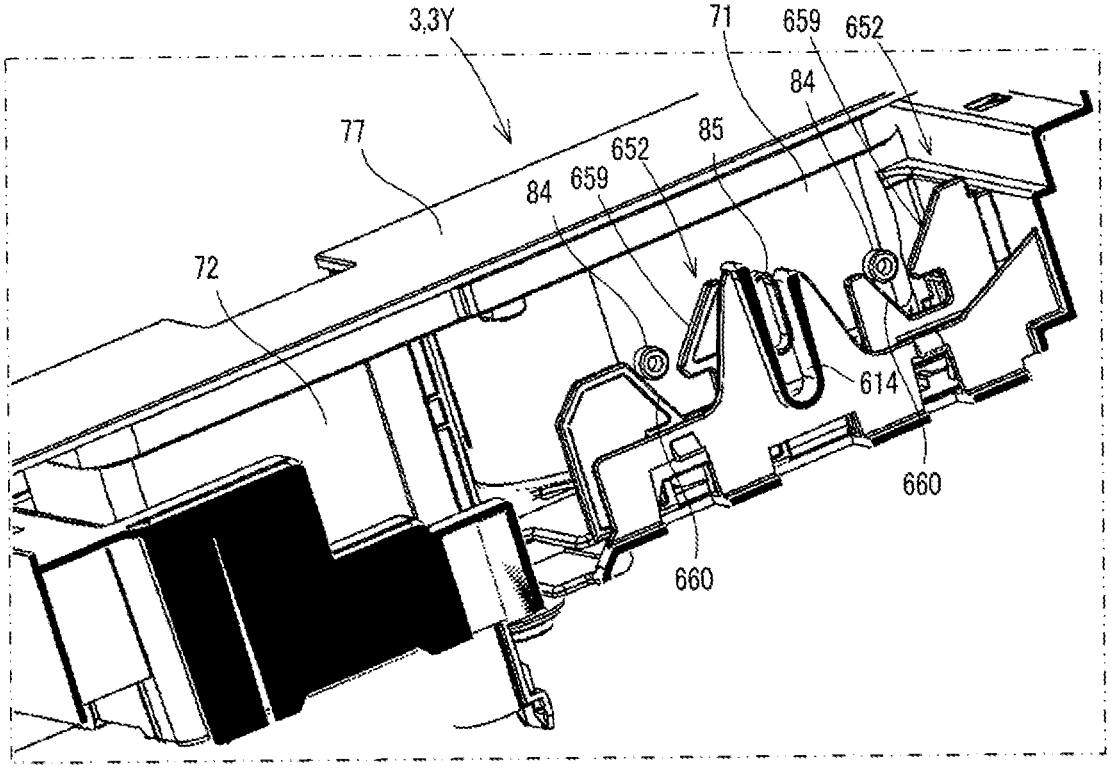
FIG. 16 is a perspective diagram showing the toner container disposed at a pull-out position.

In addition, a second cam 660 (an example of a second pushing member of the present disclosure) is formed integrally with the movement frame 65. The second cam 660 is provided at a position opposite from the third cam 659 in the height direction D11. The second cam 660 is an inclined cam that is inclined at a 45-degree angle. As shown in FIG. 13 and FIG. 16, when the pushing operation is performed on the operation member 69, and the movement frame 65 is moved from the locked position to the unlocked position by the first cam 654, the second cam 660, in response to the movement of the movement frame 65, pushes the protruding boss 84 in an opposite direction of a direction in which the operation member 69 is pushed. This allows for the second cam 660 to move the toner container 3 from the attachment position to the pull-out position.

Specifically, during the movement of the movement frame 65 to the unlocked position, the second cam 660 comes in contact with the protruding boss 84 that is moving relatively from the lock groove 657 toward the opening 658, converts a force received from the contact into a pushing force in the opposite direction, and applies the converted force to the protruding boss 84. With this configuration, the toner container 3 is moved from the attachment position toward the pull-out position (see FIG. 13 and FIG. 16).

When the pushing operation on the operation member 69 is released, the movement frame 65 moves, by the actuating force from the coil spring 68, in a returning direction that extends toward the locked position. At this time, as shown in FIG. 13, the protruding boss 84 moves from the opening 658 of the lock groove 657 toward an outer side position. Accordingly, when the movement frame 65 moves in the returning direction, the third cam 659 comes in contact with the protruding boss 84 (see FIG. 14). With this configuration, the third cam 659 pushes the protruding boss 84 in a direction opposite of that of the pushing operation on the operation member 69, or in other words, the third cam 659 pushes the protruding boss 84 further toward the pull-out position. By receiving a pushing force from the third cam 659, the toner container 3 is able to arrive at the pull-out position.

As described above, in the present embodiment, since the toner container 3 includes the exterior panel 77, the toner container 3 can be replaced as long as a large enough space is secured in which the toner container 3 can be removed from the attachment portion 58. In addition, since the attachment portion 58 is configured as described above, the toner container 3 can be attached and removed to and from the toner container 3, as long as the secured space has a depth equal to that of the toner container 3 in the depth direction D13. Thus, it is possible to make smaller, in comparison to what is necessary for the conventional apparatus, the space necessary for replacing the toner container 3, and improve a degree of freedom of installation of the image forming apparatus 10.

In addition, since the toner container 3 can be unlocked and pushed out from the attachment position to the pull-out position just by pushing the operation member 69, it is possible for a user to easily remove the toner container 3.

Furthermore, since the toner container 3 is pushed out to the pull-out position in response to the movement of the movement frame 65 in the returning direction when the pushing operation on the operation member 69 is released, it is possible for a user to easily remove the toner container 3.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

a housing;

a toner container configured to be attached at an attachment position that is specified inside the housing; and a container supporting portion configured to support the toner container such that the toner container is movable between the attachment position and a pull-out position that is separated from the attachment position by a specific distance toward a specific first surface of the housing that is positioned at an outermost side of the housing, wherein an exterior member of the toner container is flush with an exterior of the first surface of the housing when the toner container is in an attached state in which the toner container is held at the attachment position by the container supporting portion, and the exterior member is made with a same material as the housing, and has a same color as the housing.

2. The image forming apparatus according to claim 1, wherein when the toner container is at the attachment position, a lock piece included in the toner container is locked in a first direction by the container supporting portion, wherein the first direction is perpendicular to the first surface, and the container supporting portion includes:

a supporting member configured to support the toner container such that the toner container is movable between the attachment position and the pull-out position, a movement member provided on the supporting member movably in a second direction that extends along the first surface, and configured to move between a locked position where the lock piece is locked, and a release position where the lock piece is unlocked, an operation member provided on the supporting member, and a first pushing member configured to push, in response to a pushing operation on the operation member toward an inner side of the housing, the movement member from the locked position toward the release position.

3. The image forming apparatus according to claim 2, further comprising an elastic member configured to elastically actuate the movement member toward the locked position, wherein the first pushing member pushes, against an actuating force from the elastic member, the movement member from the locked position toward the release position, and moves the movement member to the release position.

4. The image forming apparatus according to claim 2, wherein the first pushing member is a first cam that is provided on the movement member, and configured to convert, when the pushing operation is performed on the operation member, a pushing force received from the operation member into a force directed toward the release position.

5. The image forming apparatus according to claim 2, further comprising a second pushing member provided on the movement member, and configured to, in response to the movement member moving from the locked position to the release position, push the lock piece in an opposite direction of a direction of the pushing operation on the operation member, and move the toner container from the attachment position to the pull-out position.

6. An image forming apparatus, comprising:

an apparatus body;

a toner container configured to be attached at an attachment position that is specified inside the apparatus body;

a container supporting portion configured to support the toner container such that the toner container is movable between the attachment position and a pull-out position that is separated from the attachment position by a specific distance toward a specific first surface of the apparatus body; and an exterior member that is provided on the toner container, and constitutes an exterior of the first surface when the toner container is in an attached state, where the toner container is held at the attachment position by the container supporting portion, wherein when the toner container is at the attachment position, a lock piece included in the toner container is locked in a first direction by the container supporting portion, wherein the first direction is perpendicular to the first surface, the container supporting portion includes:

a supporting member configured to support the toner container such that the toner container is movable between the attachment position and the pull-out position;

a movement member provided on the supporting member movably in a second direction that extends along the first surface, and configured to move between a locked position where the lock piece is locked, and a release position where the lock piece is unlocked;

an operation member provided on the supporting member; and a first pushing member configured to push, in response to a pushing operation on the operation member toward an inner side of the apparatus body, the movement member from the locked position toward the release position, and the image forming apparatus further comprises:

a second pushing member provided on the movement member, and configured to, in response to the movement member moving from the locked position to the release position, push the lock piece in an opposite direction of a direction of the pushing operation on the operation member, and move the toner container from the attachment position to the pull-out position, wherein the second pushing member is a second cam configured to apply a pushing force to the lock piece in the opposite direction, when the movement member moves from the locked position toward the release position and comes in contact with the lock piece.

7. The image forming apparatus according to claim 5, further comprising a third pushing member provided on the movement member, and configured to, when the movement member moves in a returning direction toward the locked position after the pushing operation on the operation member has been released, push the lock piece further in the opposite direction and cause the toner container to arrive at the pull-out position.

8. The image forming apparatus according to claim 7, wherein the third pushing member is a third cam configured to apply a pushing force to the lock piece in the opposite direction, when the movement member moves in the returning direction and comes in contact with the lock piece after the pushing operation on the operation member has been released.

9. A toner container configured to be movable between an attachment position that is specified inside an image forming apparatus, and a pull-out position that is separated from the attachment position by a specific distance toward a specific first surface of a housing of the image forming apparatus that is positioned at an outermost side of the housing, the toner container comprising:

an exterior member of the toner container that is flush with an exterior of the first surface of the housing when the toner container is disposed at the attachment position, wherein the exterior member is made with a same material as the housing, and has a same color as the housing.

10. An image forming apparatus, comprising:

a housing;

a toner container configured to be attached at an attachment position that is specified inside the housing; and a container supporting portion configured to support the toner container such that the toner container is movable between the attachment position and a pull-out position that is separated from the attachment position by a specific distance toward a specific first surface of the housing that is positioned at an outermost side of the housing, wherein an exterior member of the toner container is flush with an exterior of the first surface of the housing when the toner container is in an attached state in which the toner container is held at the attachment position by the container supporting portion, and in the attached state, an outer surface of the exterior member is disposed on a same plane as the first surface of the housing.

11. A toner container configured to be movable between an attachment position that is specified inside an image forming apparatus, and a pull-out position that is separated from the attachment position by a specific distance toward a specific first surface of a housing of the image forming apparatus that is positioned at an outermost side of the housing, the toner container comprising:

an exterior member of the toner container is flush with an exterior of the first surface of the housing in an attached state in which the toner container is held at the attachment position, wherein in the attached state, an outer surface of the exterior member is disposed on a same plane as the first surface of the housing.

12. The image forming apparatus according to claim 1, wherein the toner container further includes a lock piece, and the container supporting portion further includes:

a supporting member configured to support the toner container such that the toner container is movable between the attachment position and the pull-out position, a movement member movably provided on the supporting member, and configured to move between a locked position where the lock piece is locked, and a release position where the lock piece is unlocked, a first pushing member configured to push, in response to a pushing operation on an operation member, the movement member from the locked position toward the release position, and a second pushing member provided on the movement member, and configured to, in response to the movement member moving from the locked position toward the release position and coming into contact with the lock piece, push the lock piece in an opposite direction of a direction of the pushing operation on the operation member, and move the toner container from the attachment position to the pull-out position.

* * * * *